US006514188B2

(12) United States Patent
Kostiza

(10) Patent No.: US 6,514,188 B2
(45) Date of Patent: Feb. 4, 2003

(54) FOLDING JAWS CYLINDER

(75) Inventor: Simon Kostiza, Fussgönheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 3 days.

(21) Appl. No.: 09/851,160

(22) Filed: May 9, 2001

(65) Prior Publication Data

US 2002/0032109 A1 Mar. 14, 2002

Related U.S. Application Data

(63) Continuation of application No. 09/319,944, filed as application No. PCT/DE97/02984 on Dec. 19, 1997, now Pat. No. 6,283,906.

(30) Foreign Application Priority Data

Dec. 21, 1996 (DE) ..... 196 53 803

(51) Int. Cl.[7] ..... B31F 1/08
(52) U.S. Cl. ..... 493/424; 493/442; 493/476
(58) Field of Search ..... 493/424, 425, 493/434, 442, 476, 426

(56) References Cited

U.S. PATENT DOCUMENTS 4,511,044 A 4/1985 Connor et al.
5,057,064 A 10/1991 Michalik
5,201,701 A 4/1993 Roettger et al.
5,215,014 A 6/1993 Burger et al.
5,417,642 A 5/1995 Boronka et al.
5,429,578 A 7/1995 Calbrix et al.
5,653,429 A 8/1997 Michalik et al.
5,846,177 A 12/1998 Mayr
5,924,970 A 7/1999 Wingate
5,937,757 A * 8/1999 Jackson et al.
6,283,906 B1 * 9/2001 Kostiza
6,358,192 B1 * 3/2002 Michalik
6,398,704 B1 * 6/2002 Shibuya et al.

FOREIGN PATENT DOCUMENTS

DE 2537920 A1 3/1977

* cited by examiner

*Primary Examiner*—Eugene Kim
(74) *Attorney, Agent, or Firm*—Jones, Tullar & Cooper, P.C.

(57) ABSTRACT

A folding jaw cylinder utilizes folding jaw pairs that automatically adjust the folding gap between the two jaws in each pair in response to the thickness of the folded product. A dual working chamber piston-cylinder unit is placed between first and second rotational carriers of the folding jaw members. One of the chambers is filed with liquid and is linked to a hydraulic accumulator by ways of a flow control valve. The second chamber is provided with compressed air.

3 Claims, 3 Drawing Sheets

Figure 1:
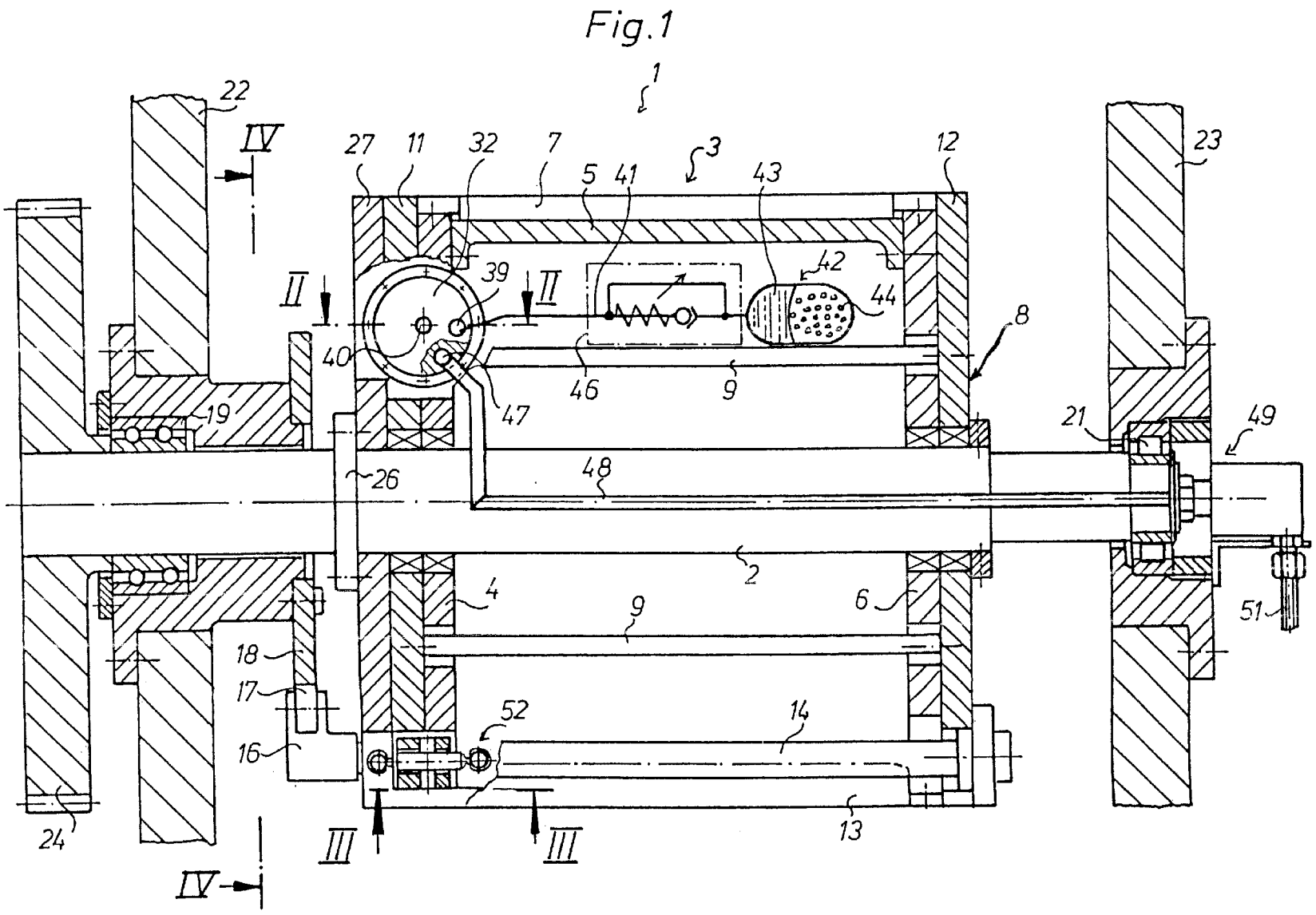

1
2
3
4
5
6
7
8
9
11
12
13
14
16
17
18
19
21
22
23
24
26
27
32
39
40
41
42
43
44
46
47
48
49
51
52
II
III
IV

FOLDING JAWS CYLINDER

This is a continuation of application Ser. No. 09/319,944 file Aug. 13, 1999, now U.S. Pat. No. 6,283,906, which is a 371 of PCT/DE97/02984, filed Dec. 19, 1997.

The invention relates to a folding jaw cylinder for a folding apparatus of rotary printing presses in accordance with the preamble of claim 1.

A folding jaw cylinder with a device for adjusting the folding gap in accordance with the thickness of the product to be folded is known from DE 25 37 920 A1. This adjustment is performed in that initially a sliding element with inclined faces is moved by a threaded spindle, which is supported on a threaded bushing and which extends in the axial direction of the cylinder. Thereafter, hingedly seated plungers extending in the radial direction of the cylinder are actuated by the inclined faces.

However, in connection with said folding jaw cylinder it is disadvantageous that during the start-up of, for example, a collection production with triple collection, it loses the products as often, i.e. two or three times, as the preset folding jaws receive a product of a final product thickness.

It is the object of the invention to produce a folding jaw cylinder.

In accordance with the invention, this object is attained by the features of the characterizing portion of claim 1.

The advantages which can be achieved in particular by the present invention reside in that, in its basic position, the folding jaw opening is adapted automatically to the product thickness. This means that the thickness of a folding product taken over by the folding jaws at the start-up of multiple collection production is used to set the folding jaw gap.

In this way, regardless of its thickness, each folding product is individually grasped, for example during the start-up of a production of multiply-collected folding products, in such a way that its sliding out of the folding jaw openings is prevented.

An exemplary embodiment of the invention is represented in the drawings and will be described in greater detail in what follows.

Figure 3:
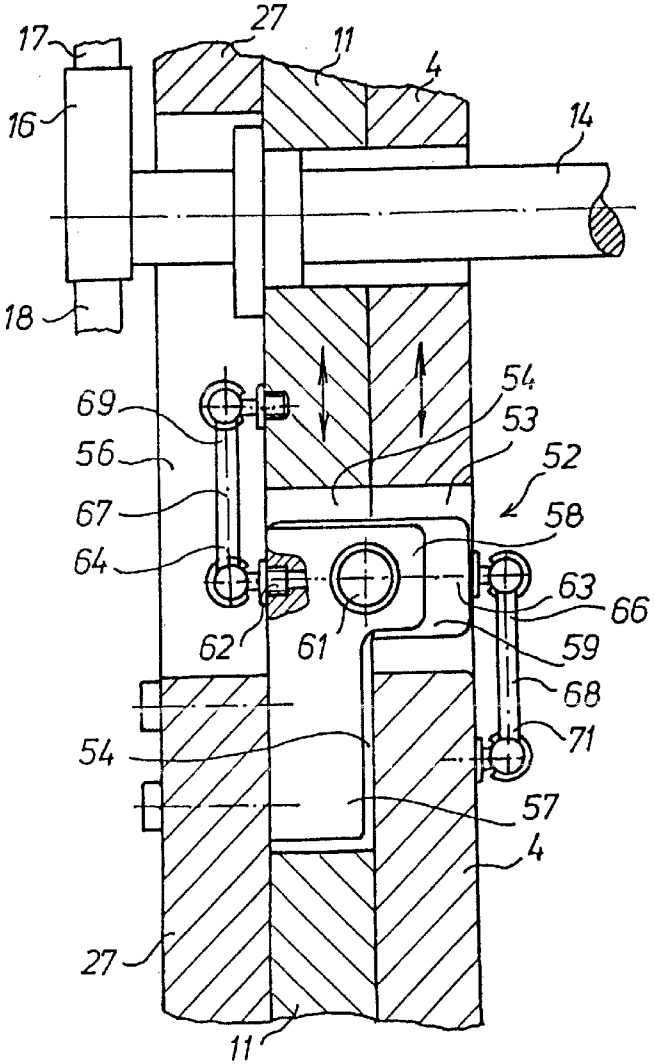
Figure 2:
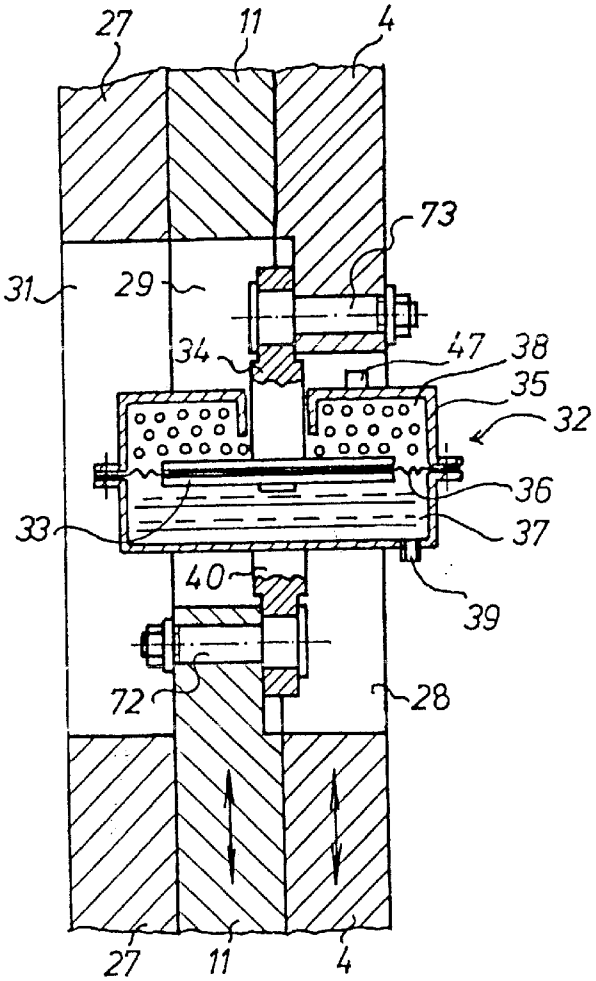
Figure 4:
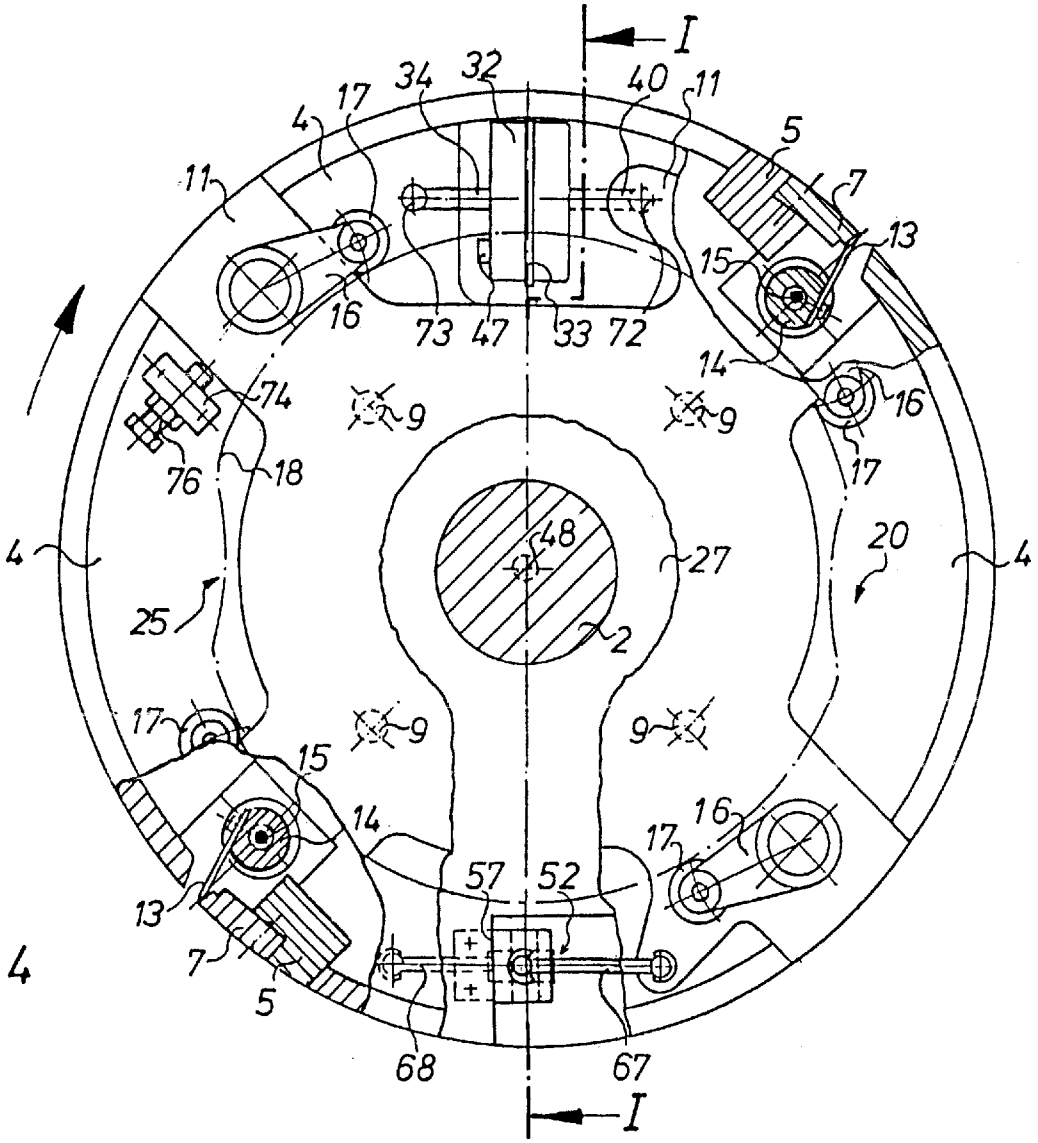

Shown are in:

FIG. 1, a schematic representation of a longitudinal section through a folding jaw cylinder, approximately corresponding to the line I—I in FIG. 4, FIG. 2, a section II—II in accordance with FIG. 1 with an enlarged representation of a diaphragm cylinder-piston unit;

FIG. 3, a section III—III in accordance with FIG. 1 with an enlarged representation of a synchronizing device;

FIG. 4, a cross section IV—IV through the folding jaw cylinder in accordance with FIG. 1.

In a known manner, a folding jaw cylinder 1 consists of a first support body 2, which is rotatably seated on a shaft 2 and has two lateral disks 4, 6 embodied as solid disks. The lateral disks 4, 6 are spaced apart and connected with each other by, for example four cross bars 5, which receive fixed folding jaw elements 7 evenly distributed over the circumference of the disks. The folding jaw cylinder 1 furthermore has a second support body 8, which is also rotatably seated on the shaft 2. The support body 8 is formed by two lateral disks 11, 12, which are spaced apart from each other and are maintained at cylinder width by a number of supports 9. The lateral disks 11, 12 are partially cut open (FIG. 4). On its circumference this second support body contains, for example, four controllable folding jaw elements 13, which are also evenly spaced. These folding jaw elements 13 are respectively fastened, for example next to each other, on a spindle 14, seated fixed in place on the support body. At one end the spindle 14 projects out of the support body 8 and is connected via a lever arm 16 and a cam roller 17 with a control cam 18, which is fixed in place on a lateral frame. The control cam 18 has a curve bottom 20 for opening and a curve bottom 25 for closing the folding jaw elements 7, 13. The control cam 18 is represented in dash-dotted lines (FIG. 4). A torsion bar 15 is located in the hollow spindle 14, one side of which is fastened on the disk 12 and the other side on the lever arm 16. In a simplified way, in FIG. 1 the position of the folding jaw elements 7, 13 is represented offset by 45° in respect to the position of the folding jaw elements 7, 13 in FIG. 4.

The shaft 2 of the folding jaw cylinder 1 is seated in lateral frames 22, 23 and is rotatable by means of rolling bearings 19, 21. On one end, the shaft 2 is connected, fixed against relative rotation, with a drive gear wheel 24. The drive gear wheel 24 meshes with a drive gear wheel, not represented, of a collection cylinder, for example.

On the drive side, the shaft 2 has a collar 26 between the lateral frame 22 and the folding jaw cylinder 1. The collar 26 is connected, fixed against relative rotation, with a drive disk 27, for example by means of screws. The drive disk 27 extends parallel with the lateral disk 4 of the first support body 3 and rests against it (FIG. 1).

The lateral disks 4, 11, as well as the drive disk 27 each have a respective recess 28, 29, 31, preferably on the drive side of the folding jaw cylinder 1. A work cylinder 32, for example a double-action cylinder-piston unit 32, 33, is arranged in the recess 28, 29, 31. The work cylinder 32 is connected with the lateral disk 11 by means of a holder 40, attached to its housing 35, and a screw 72. The free end of the piston rod 34 is connected via a screw 73 with the lateral disk 4.

The cylinder-piston unit 32, 33 is suitably designed as a diaphragm cylinder. This means, for example, that the piston 33 is embodied in a disk shape and has a circular ring-shaped diaphragm 36 on its periphery. The diaphragm 36 is fixed in place by its exterior circumference on the housing 35 of the cylinder 32. This can be achieved by clamping it in place between two housing elements, for example. In this way a gas- and liquid-proof separation is achieved between a first chamber 37 of the cylinder 32 and a second chamber 38 of the cylinder 32. A piston stroke of this cylinder 32 is only a few millimeters (FIG. 2).

The first chamber 37 is filled with a pressure medium 43, for example hydraulic fluid. The chamber 37 is connected via an outlet connector 39, as well as a line 41, with a known energy accumulator, for example a hydraulic reservoir 42, which is fastened, for example on a support 9 of the second support body 8. On the side close to the line, the hydraulic reservoir 42 contains a fluid, and a gas 44 in an expandable, or respectively compressible plastic bag. This gas can be air or nitrogen.

A throttle check valve 46 is arranged between the first chamber 37 of the cylinder 32 and the hydraulic reservoir 42 and acts in the direction toward the hydraulic reservoir 42.

The second chamber 38, filled with the gas 44, of the cylinder 32 is connected via an outlet connector 27, as well as a line 48, with a compressed air source, not represented. Here, the line 48 first extends inside the shaft 2. A known rotary inlet 49 located at the shaft end makes a connection with a line 51 continuing to the compressed air source (FIG. 1).

A synchronization device 52 is located in a recess 53, 54, 56 of the disks 4, 11, 27. The synchronization device 52 is located approximately diametrically opposite the cylinder-piston unit 32, 33 and can be arranged on the drive disk.

The synchronization device 52 consists of a synchronizing coupled gear. At one end of its recess 56, the drive disk 27 is fixedly connected with an L-shaped bearing block 57. The shorter leg of the bearing block 57 is made fork-shaped. A two-armed lever 59 is guided in the fork 58, which is seated centered on a bearing bolt 61. The bearing bolt passes through the fork 58 in the radial direction toward the lateral disk 4, 11. The ends 62, 63 of the two-armed lever 59 are hingedly connected with first ends 64, 66 of couplers 67, 68. A second end is hingedly connected at the end of the recess 54 with the lateral disk 11 of the second support body 8 of the folding jaw cylinder 1. A second end 71 of the second coupler 68 is hingedly connected in the opposite direction from the end 69 of the first coupler 67 at the end of the recess 53 with the lateral disk 4 of the first support body 3. The couplers 67, 68 extend in the shape of a secant in respect to the lateral disks 11, 4.

In the top view (FIG. 3), the synchronization device 52 consisting of the two-armed lever 59 and the two hinged couplers 67, 68 represents a reflected letter Z.

The function of the folding jaw cylinder is as described in what follows. In the course of drawing a paper web into a rotary printing press, or respectively an associated folding apparatus, the folding jaw cylinder 1 turns at a low number of revolutions, i.e. at creep speed. Since there are no products yet to be received in the folding flaps 7, 13, the compressed air supplied to the second chamber 38 of the cylinder-piston unit 32, 33 causes the fluid located in the first chamber 37 to slowly flow into the hydraulic reservoir 42 via the line 41, as well as through the throttle check valve 46 acting in the throttling direction. In this case the air pressure is approximately 3 to 6 bar and is higher than the pressure acting in the first chamber 37. In place of the chamber 38 charged with compressed air, the counterforce can also be generated by a spring. Because of this, the two support bodies 3, 8, and therefore the folding jaw elements 7, 13, move toward each other in opposite directions until a preset gap of a minimum width of, for example, 0.1 mm, constituting a basic setting, has been reached.

This gap can be preset by means of a stop. For example, the stop consists of a bearing block 74, which receives a lockable screw 76 and is fastened on the lateral disk 4. One end of the screw 76 cooperates with the lateral disk 11 (FIG. 4).

As soon as a first product has been transferred by a collecting cylinder to the folding jaw cylinder 1, the movable folding jaw elements 13 are controlled via the cam gear 14, 16, 17, 18 so that they close. In the course of this a force is generated between the folding jaw elements 7, 13, which pushes the folding jaw elements 7, 13 apart in accordance with the thickness of the product.

This product thickness related force, which is a function of the separation between the folding jaw elements 7, 13 and which is generated by the product thickness and acting on the work cylinder 32 works, together with the force of the fluid 43 in the first chamber 37, against the force of the compressed air in the second chamber 38. Fluid 43 under pressure is rapidly drawn from the hydraulic reservoir 42 to the first chamber 37 of the cylinder-piston unit 32, 33 without a throttling effect of the throttle check valve 46. A corresponding movement of the piston 33 in the direction of the second chamber 38 filled with compressed air only takes place as far as the counterforce of the compressed air supplied via the rotary inlet 49 will permit.

After the removal of the folded product from the folding jaw elements 7, 13 of the folding jaw cylinder 1; i.e. after the cam roller 17 and torsion bar 15 have moved the movable folding jaw element 13 away from the fixed jaw element 7 to allow removal of the folded product, the product thickness related force provided by the now removed folded products no longer exists. The. air pressure provided via the rotary inlet 49 acts on the piston 33 of the cylinder-piston unit 32, 33. Now, the fluid 43 in the first chamber 37 is forced back into the hydraulic reservoir 42 by the air pressure in the second chamber 38 against the throttling effect of the throttle check valve 46. But this flow of fluid 43 into reservoir 42 is restricted by the throttle check valve 46, depending on the setting of the throttle check valve 46, for example because it is known that a thicker product must be picked up by the next following folding jaw elements 7, 13. As a result, a product thickness related force is again created between the folding jaw elements 7, 13 after closing. Therefore the first and second support bodies 3, 8 turn further apart. In the course of this, the piston 33 moves in the direction of the second chamber 38 filled with compressed air, until the cam roller 17 has reached the highest point of the control cam 18 and the folding jaw elements 7, 13 are closing again. In the process, the fluid 43 in the first chamber 37 again tries to run off into the hydraulic reservoir 42 against the direction of the throttling effect of the throttle check valve 46.

Thus, the first chamber 37 of the work cylinder 32, 33 is charged with a pressure medium, wherein the supply and removal of the pressure medium takes place with different amounts per unit of time (the supply takes place at a greater speed than the removal). Here, the speed of the supply is a multiple of, i.e. at least twice, the speed of the removal.

When after several collections the final thickness of the product has been reached, the folding jaws 7, 13 have been set to this thickness.

After increasing the rpm of the machine, a hydraulically, pneumatically or mechanically acting known blocking device can become automatically active, which fixedly connects the lateral disks 11, 4 with the drive disk 27.

The synchronization device 52 sees to an even setting of the folding jaw gap in both directions.

It is also possible to utilize a different gear with little play and less automatic locking for the synchronization device.

The work cylinder 32 can also be arranged between a support body and a folding jaw element, which is movable in relation to it, or between a control element, for example the cam roller 17, and the associated folding jaw element.

LIST OF REFERENCE NUMERAL

1 Folding jaw cylinder
2 Shaft (1)
3 Support body, first
4 Lateral disk (3)
5 Cross bars
6 Lateral disk (4)
7 Folding jaw element, fixed
8 Support body, second
9 Support (11, 12)
10 -
11 Lateral disk (8)
12 Lateral disk (8)
13 Folding jaw element, controllable
14 Spindle
15 Torsion bar
16 Lever arm
17 Cam roller
18 Control cam

19 Rolling bearing
20 Curve bottom (18)
21 Rolling bearing
22 Lateral frame
23 Lateral frame
24 Drive gear wheel
25 Curve bottom (18)
26 Collar (2)
27 Drive disk
28 Recess (4)
29 Recess (11)
30 -
31 Recess (27)
32 Cylinder
33 Piston
34 Piston rod
35 Housing (32)
36 Diaphragm (33)
37 Chamber, first (32)
38 Chamber, second (32)
39 Outlet connector (37)
40 Holder
41 Line (39)
42 Hydraulic reservoir
43 Fluid
44 Gas
45 -
46 Throttle check valve (41)
47 Outlet connector (38)
48 Line
49 Rotary inlet (2)
50 -
51 Line
52 Synchronization device
53 Recess (4)
54 Recess (11)
55 -
56 Recess (27)
57 Bearing block (52)
58 Fork (57)
59 Lever, two-armed (52)
60 -
61 Bearing bolt (59)
62 End (59)
63 End (59)
64 End, first (67)
65 -
66 End, first (68)
67 Coupler, first (52)
68 Coupler, second (52)
69 End, second (67)
70 -
71 End, second (68)
72 Screw (4)
73 Screw (11)
74 Bearing block (4, 76)
75 -
76 Screw, lockable (74)

What is claimed is:

1. A folding jaw cylinder comprising:

at least one folding jaw including first and second folding jaw elements, said first and second folding jaw elements defining a folding jaw gap having a gap distance, said first and second folding jaw elements being operable to selectively grasp and release a product placed in said folding jaw gap;

means supporting each of said first and second folding jaw elements on the folding jaw cylinder for movement relative to each other to vary said folding jaw gap distance defined by said first and second folding jaw elements; and means for shifting at least one of said first and second relatively movable folding jaw elements on the folding jaw cylinder with respect to the other of said relatively movable first and second folding jaw elements to vary said folding jaw gap distance defined by said first and second folding jaw elements in response to a force generated between said first and second folding jaw elements, said force between said first and second folding jaw elements being generated by a thickness of a product received in said folding jaw gap defined by said first and second folding jaw elements, said force increasing with an increase of said thickness of a product received in said folding jaw gap.

2. A folding jaw cylinder comprising:

at least one folding jaw including first and second folding jaw elements, said first and second folding jaw elements defining a folding jaw gap having a gap distance, said first and second folding jaw elements being operable to selectively grasp and release a product placed in said folding jaw gap;

means supporting each of said first and second folding jaw elements on the folding jaw cylinder for movement relative to each other to vary said folding jaw gap distance defined by said first and second folding jaw elements; and means for shifting at least one of said first and second relatively movable folding jaw elements on the folding jaw cylinder with respect to the other of said relatively movable first and second folding jaw elements for increasing and reducing said folding jaw gap distance in response to a force generated between said first and second folding jaw elements, said force between said first and second folding jaw elements being generated by a thickness of a product received in said folding jaw gap, said force increasing with an increase of said thickness of a product received in said folding jaw gap, said means for shifting at least one of said first and second folding jaw elements on the folding jaw cylinder increasing said folding jaw gap at a first speed and reducing said folding jaw gap at a second speed, said first speed being greater than said second speed.

3. The folding jaw cylinder of claim 2 wherein said first speed is a multiple of said second speed.

* * * * *